US011536109B1

(12) United States Patent
Alley

(10) Patent No.: US 11,536,109 B1
(45) Date of Patent: Dec. 27, 2022

(54) ROTATABLE WEAR SLEEVE FOR WELLHEAD PRESSURE-CONTROL DEVICE

(71) Applicant: ADS Services, LLC, Midland, TX (US)

(72) Inventor: Sean Alley, Wolfforth, TX (US)

(73) Assignee: ADS SERVICES, LLC, Midland, TX (US)

( * ) Notice: Subject to any disclaimer, the term of this patent is extended or adjusted under 35 U.S.C. 154(b) by 0 days.

(21) Appl. No.: 17/512,423

(22) Filed: Oct. 27, 2021

(51) Int. Cl.
*E21B 33/068* (2006.01)
*E21B 33/08* (2006.01)

(52) U.S. Cl.
CPC ..... *E21B 33/068* (2013.01); *E21B 33/085* (2013.01)

(58) Field of Classification Search
CPC ..... E21B 33/068; E21B 33/085; E21B 17/10; E21B 17/1007
See application file for complete search history.

(56) References Cited

U.S. PATENT DOCUMENTS 4,285,406 A * 8/1981 Garrett ..... E21B 3/04 277/343
4,293,047 A * 10/1981 Young ..... E21B 33/085 277/343
4,304,310 A * 12/1981 Garrett ..... E21B 3/04 285/16
4,363,357 A * 12/1982 Hunter ..... E21B 33/085 285/55
4,811,799 A * 3/1989 Blackwell ..... E21B 21/16 166/88.4
5,947,528 A * 9/1999 Campbell ..... F16L 58/08 285/55
6,543,811 B1 * 4/2003 Campbell ..... F16L 58/08 285/55
2020/0131889 A1 * 4/2020 Robinson ..... E21B 43/2607
2020/0284132 A1 * 9/2020 Fink ..... F16L 57/06

* cited by examiner

*Primary Examiner* — Matthew R Buck

(57) ABSTRACT

A wear sleeve for use with a rotating control device (RCD) includes a wear insert and a retainer flange. The wear insert is formed in a tube shape with an outer profile to match an inner profile of a downstream neck of the RCD to be inserted into the downstream neck. The retainer flange extending from an outer surface of the wear insert to couple with a neck flange at an end of the downstream neck of the RCD.

18 Claims, 15 Drawing Sheets

ROTATABLE WEAR SLEEVE FOR WELLHEAD PRESSURE-CONTROL DEVICE

TECHNICAL FIELD

This disclosure relates generally to replaceable wear inserts for oilfield drilling and production equipment. More specifically, this disclosure relates a rotatable wear sleeve for a wellhead pressure-control device such as a rotatable control device (RCD) or a diverter head for a blow-out preventer (BOP).

BACKGROUND

During well drilling, fracking, production or other operations involving abrasive fluid flow situations, destructive wear can occur on exposed inside surfaces of a wellhead pressure-control device such as a rotatable control device (RCD) or a diverter head for a blow-out preventer (BOP). Highly abrasive flow situations can occur when drilling with air, foam, water or oil-based drilling fluids carrying abrasive well born drill cuttings, sand or other materials at such a rate that they erode the inner diameter of the device outlet and flowline.

SUMMARY

This disclosure provides a rotatable wear sleeve for wellhead pressure-control device.

In a first embodiment, a wear sleeve for use with a rotating control device (RCD) includes a wear insert and a retainer flange. The wear insert is formed in a tube shape with an outer profile to match an inner profile of a downstream neck of the RCD to be inserted into the downstream neck. The retainer flange extends from an outer surface of the wear insert to couple with a neck flange at an end of the downstream neck of the RCD.

In certain embodiments, the retainer flange includes at least two through holes for connecting a tool to rotate the wear sleeve.

In certain embodiments, the retainer flange further includes at least two threaded holes for aligning with securing holes in the retainer flange to the neck flange. At least two retaining bolts can be inserted through the thread holes and the securing holes.

In certain embodiments, the bolts do not interfere with a downstream component connecting to the neck flange using the through holes of the retainer flange.

In certain embodiments, the retainer flange is integral with the wear insert.

In certain embodiments, the retainer flange is integral at an intermediate part of the wear insert in a manner that the wear insert extends from both sides of the retainer flange.

In certain embodiments, the retainer flange is mechanically coupled to the wear insert using a threaded connection.

In certain embodiments, the retainer flange includes a retainer recess and the wear insert includes a wear protrusion extending from an outer surface of the wear insert to couple with the retainer recess.

In certain embodiments, the wear protrusion includes a seal recess for accommodating a ring seal between the wear protrusion and the retainer recess.

In certain embodiments, the retainer flange includes a retainer lip that abuts with an end of the wear insert.

In certain embodiments, the wear insert includes a seal recess to accommodate a ring seal between the wear insert and the retainer lip.

In certain embodiments, the retainer flange includes an upstream wear insert on a first side of the retainer lip and a downstream wear insert on a second side of the retainer lip.

In certain embodiments, the wear insert extends from both sides of the retainer flange.

In certain embodiments, a flange seal is accommodated in a ring recess between the neck flange and the retainer flange.

In certain embodiments, an upstream portion of the wear insert includes at least one seal recess to accommodate at least one ring seal between an exterior of the wear insert and an interior of the downstream neck of the RCD.

In certain embodiments, a downstream portion of the wear insert adjacent to the retainer flange includes at least one seal recess to accommodate at least one ring seal between an exterior of the wear insert and an interior of the downstream neck.

In certain embodiments, the retainer flange includes release threaded holes that align with a surface of the neck flange to separate the retainer flange from the neck flange when a bolt is completely inserted through the release threaded holes.

In certain embodiments, the retainer flange includes additional adjustment holes located on an outer circumference of the retainer flange.

In certain embodiments, the retainer flange includes indicators for a direction to rotate the wear sleeve.

In a second embodiment, a wear sleeve for use with a rotating control device (RCD) includes a wear insert, an insert protrusion, and a plurality of grub screws. The wear insert is formed in a tube shape with an outer profile to match an inner profile of a downstream neck of the RCD to be inserted into the downstream neck. The insert protrusion extends outwards from an outer circumference of the wear insert to match with a neck recess on the downstream neck of the RCD to limit movement of the wear insert in the downstream neck. The plurality of grub screws can lock the wear insert within the downstream neck of the RCD. The wear insert can include a plurality of notches around an end of the wear insert.

Other technical features may be readily apparent to one skilled in the art from the following figures, descriptions, and claims.

BRIEF DESCRIPTION OF THE DRAWINGS

For a more complete understanding, reference is now made to the following description taken in conjunction with the accompanying Drawings in which.

DETAILED DESCRIPTION

Figure 1:
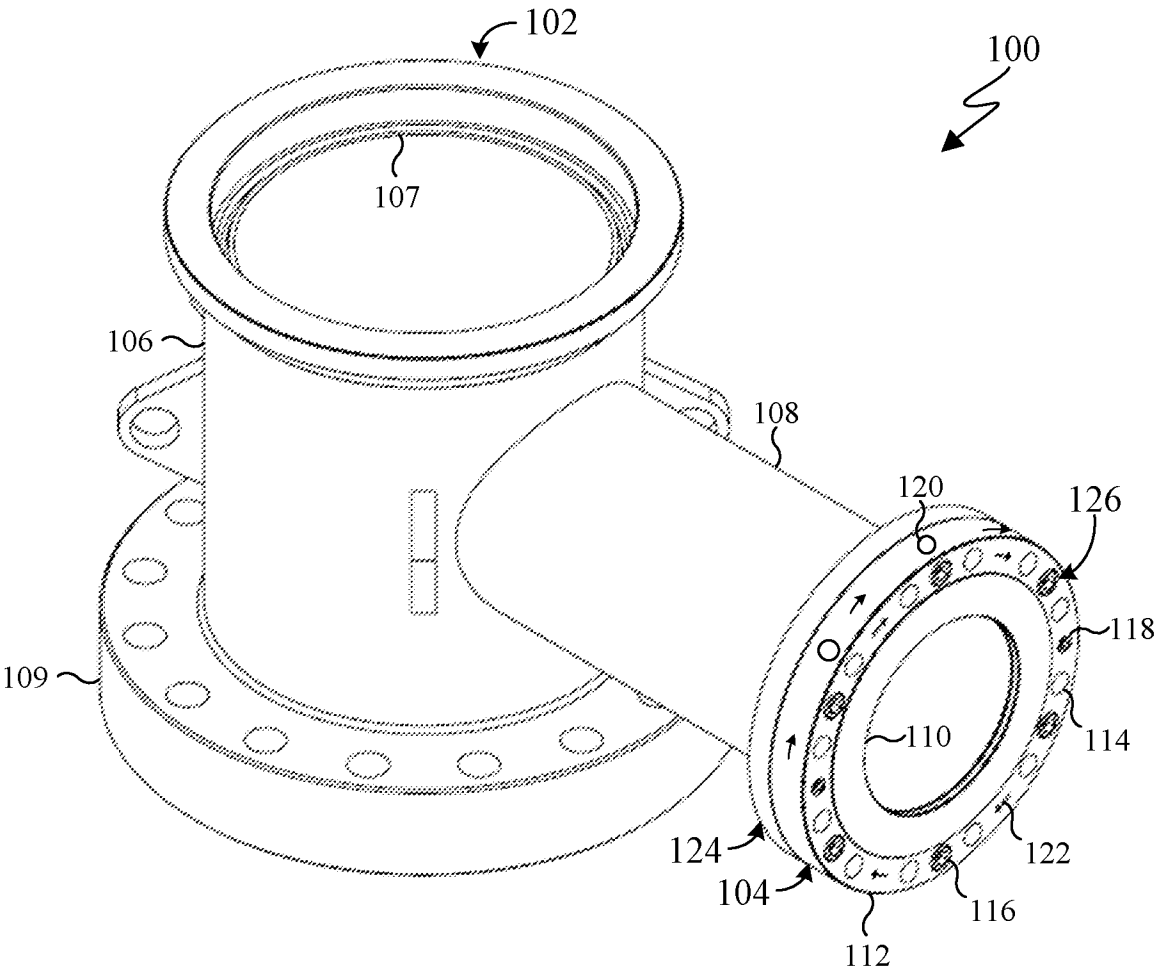
FIG. 1 is an external view of a rotating control device (RCD) assembly including an RCD and a rotatable wear sleeve according to embodiments of the present disclosure.

Referring now to the drawings, wherein like reference numbers are used herein to designate like elements throughout, the various views and embodiments of a rotatable wear sleeve for wellhead pressure-control devices are illustrated and described, and other possible embodiments are described. The figures are not necessarily drawn to scale, and in some instances the drawings have been exaggerated and/or simplified in places for illustrative purposes only. One of ordinary skill in the art will appreciate the many possible applications and variations based on the following examples of possible embodiments.

The rotatable wear sleeves described herein can be used with various types of wellhead pressure-control devices including, but not limited to, a rotational control device (RCD) and a diverter head for a blow-out preventer (BOP). For purposes of compact prosecution, the disclosures herein describe use of the rotatable wear sleeves with RCDs; however, one of ordinary skill in the art will appreciate the various embodiments could also be used with diverter heads of BOPs or with other wellhead pressure-control devices.

FIG. 1 illustrates an RCD assembly 100 in accordance with this disclosure. The embodiment of the RCD assembly 100 illustrated in FIG. 1 is for illustration only. FIG. 1 does not limit the scope of this disclosure to any particular implementation of an RCD assembly.

As shown in FIG. 1, an RCD assembly 100 can include an RCD 102 and a rotatable wear sleeve 104. The RCD 102 can be used to seal around a rotating drill string while diverting returning fluid into a side leg. The RCD 102 can include a housing 106 including an upper bowl portion 107 for receiving a bearing and seal assembly (not shown) and a lower flange 109 for connecting to the wellhead. A side leg or downstream neck 108 extends laterally from the housing 106 to divert returning fluid through the side of the housing. The housing 106 can mounted on a wellhead or valve stack with the downstream neck 108 oriented to divert the returning fluid to a secondary pipe for further processing. As a non-limiting example, the housing 106 of the RCD 102 can be made from machined carbon steel and/or alloy steel castings or forgings, or any other suitable material and manufacturing process. A typical wellhead pressure-control device such as RCD 102 can have a lower connection size within the range from 11 to 30 inches in diameter but can be as small as 7 inches and as large as 50 inches. The dimensions of the outlet leg 108 typically range from 4 to 11 inches in diameter but can be as small as 2 inches and as large as 13 inches for nominal bore. Typical operating pressure ratings of RCDs are from 50 psi to 5,000 psi, with future pressure ratings possibly being higher. However, 500-2,000 psi is a typical operating pressure range.

The fluid that is diverted from the housing 106 to the downstream neck 108 can exert significant force on the inner surface of the downstream neck during the change of fluid direction from the main housing to the neck. Further, the diverted fluid typically carries rock cuttings, sand or other hard materials that are forced against the exposed interior surfaces as the fluid impinges on the sides of the passage, thereby eroding the exposed surfaces.

To minimize erosive wear on the RCD 102 itself, the rotatable wear sleeve 104 is installed on the downstream neck 108 of the RCD. With the rotatable wear sleeve 104 in place, the wear sleeve is eroded by the fluid flow instead of the outlet neck 108. The rotatable wear sleeve 104 can include a wear insert 110 connected to a retainer flange 112. The wear insert 110 can be disposed inside the downstream neck 108 to protect the inner surface of the neck from erosion by the fluid flow. Since the force of fluid flow through the outlet neck 108 may be unevenly distributed, erosion can occur at different rates around the interior circumference of the wear sleeve 104. The wear sleeve 104 can be rotated periodically within the outlet neck 108 to exposed different portions of the wear sleeve to the strongest erosive flow. This can even-out the wear on the wear sleeve 104 and prolong its useful life. The wear insert 110 can be made from carbon steel and alloy steel castings, forgings or line pipe. The wear inserts 110 can also be made from composite materials, such as carbides. The wear inserts 110 can also include abrasion-resistant surface coatings and abrasion-resistant surface treatments. Examples of coatings and treatments that could be used with the wear inserts 110 can include carbide, Inconel and stellite via welding, high velocity oxygen fueled (HVOF), high velocity air fuel (HVAF) and other application methods.

The retainer flange 112 can be used to couple the wear insert 110 to the downstream neck 108 and also to rotate the wear insert 110 without removing the wear insert from the downstream neck 108. The retainer flange 112 can be a separate component from the wear insert 110 or integrated into a single component. The retainer flange 112 extends around a circumference of the wear insert 110 to align with a neck flange 124 at the end of the downstream neck 108 opposite from the housing 106. The retainer flange 112 can include standard through holes 114, retainer holes 116, release threaded holes 118, adjustment holes 120, and rotation indicators 122.

The standard through holes 114 can be formed in the retainer flange 112 to align with the regular connection holes in the neck flange 124. The standard through holes 114 can be threaded or non-threaded on the retainer flange 112. The standard through holes 114 allow for a downstream component to be connected to the neck flange 124 of the RCD 102 using standard connections. As a non-limiting example, the neck flange 124 and retainer flange 112 can be designed as ANSI B16.5 10" 150 #. However, other flanges can be accommodated.

The retainer holes 116 can be used to couple the wear sleeve 104 to the RCD 102. The retainer holes 116 can be threaded or non-threaded. The retainer holes 116 can align with threaded holes of the neck flange 124. The threaded holes in the neck flange 124 can be machined or formed in the neck flange 124 at the time of manufacturing or retrofitted on existing equipment. A retainer hole 116 can be positioned between alternating pairs of standard through holes 114. The retainer holes 116 can be sized differently from the through holes 114 to differentiate the holes. Furthermore, the retainer holes 116 can be threaded while the standard through holes 114 are not threaded.

A retainer bolt 126 can be inserted through the retainer holes 116 into the threaded holes of neck flange 124. The retainer bolt 126 can provide for sleeve alignment allowing a user to know how far to rotate a wear sleeve 104 after wear has occurred in a particular section. The retainer bolt 126 can also secure the retainer flange 112 to the neck flange 124 to keep the wear sleeve from being dislodged from the RCD unit 100 during rig up and rig down operations. The retainer bolt 126 can also aid in installation of the wear sleeve 104 by fully pulling the wear sleeve 104 into position within the bore of the outlet leg 108. The head of the retainer bolt 126 can fit completely into a respective retainer hole 116 to not protrude out of the surface of the retainer flange 112.

The retainer bolt 126 can be used to compress a flange seal 130 between the neck flange 124 and the retainer flange 112 and secure the retainer flange 112 to the neck flange 124. The flange groove for the flange seal 130 can be formed in the neck flange 124, the retainer flange 112, or aligned in both of the neck flange 124 and the retainer flange 112. As a non-limiting example, the retainer seals and flange seal 130 can be formed of an API 6A metal ring-type seal.

The release threaded holes 118 can be used to remove the wear sleeve 104 from the RCD 102. The release threaded holes 118 are threaded and may not corresponds to hole on the neck flange 124. A bolt that is sized for the release threaded holes 118 can be inserted through the release threaded holes 118 in order to contact a surface of the neck flange 124. The threads of the release threaded holes 118 can be designed to pull the wear sleeve 104 from the downstream neck 108 when the bolt is rotated after contacting the surface of the neck flange 124.

In some embodiments, adjustment holes 120 can be formed on the retainer flange 112 in addition to the retainer holes 116 or alternatively to the retainer holes 116. The adjustment holes 120 can be formed on an outer circumference of the retainer flange 112. The adjustment holes 120 can be spaced between pairs of adjacent standard through holes 114. The adjustment holes 120 may not be present on some embodiments of the rotating wear sleeve.

The rotation indicators 122 are indica including, but not limited to, arrows or other directional symbols that can be located on the outward facing surface of the retainer flange 112 to indicate a direction of rotation for the rotatable wear sleeve 104 to maintain even wear on the wear insert 110. The rotation indicators 122 can also be positioned on an outer circumference of the retainer flange 112. The rotation indicators 122 shown in FIG. 1 are illustrated pointing in a clockwise direction but could also be implemented in a counter-clockwise direction. The rotation indicators 122 can be painted, machined, or otherwise implemented on the retainer flange 112.

Although FIG. 1 illustrate an exemplary RCD assembly 100, various changes may be made to FIG. 1. For example, the sizes, shapes, and dimensions of the RCD assembly 100 and its individual components can vary as needed or desired. Also, the number and placement of various components of the RCD assembly 100 can vary as needed or desired. In addition, the RCD assembly 100 may be used in any other suitable process and is not limited to the specific processes described above.

Figure 2A:
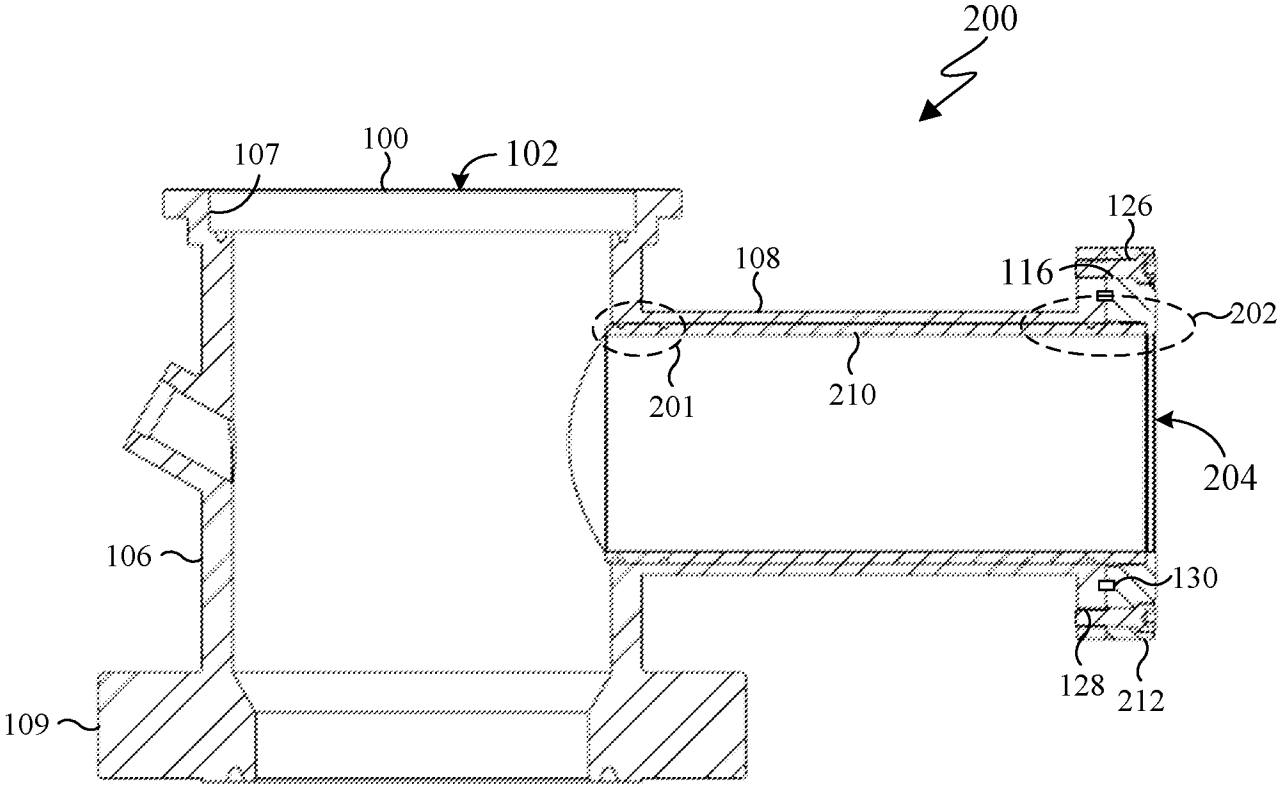
FIGS. 2A through 2C illustrate a first RCD assembly including a first rotatable wear sleeve in accordance with this disclosure.
Figure 2B:
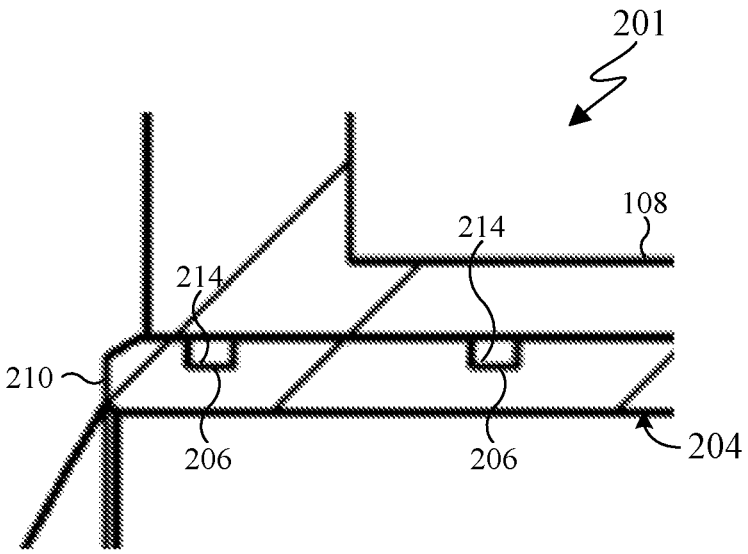
Figure 2C:
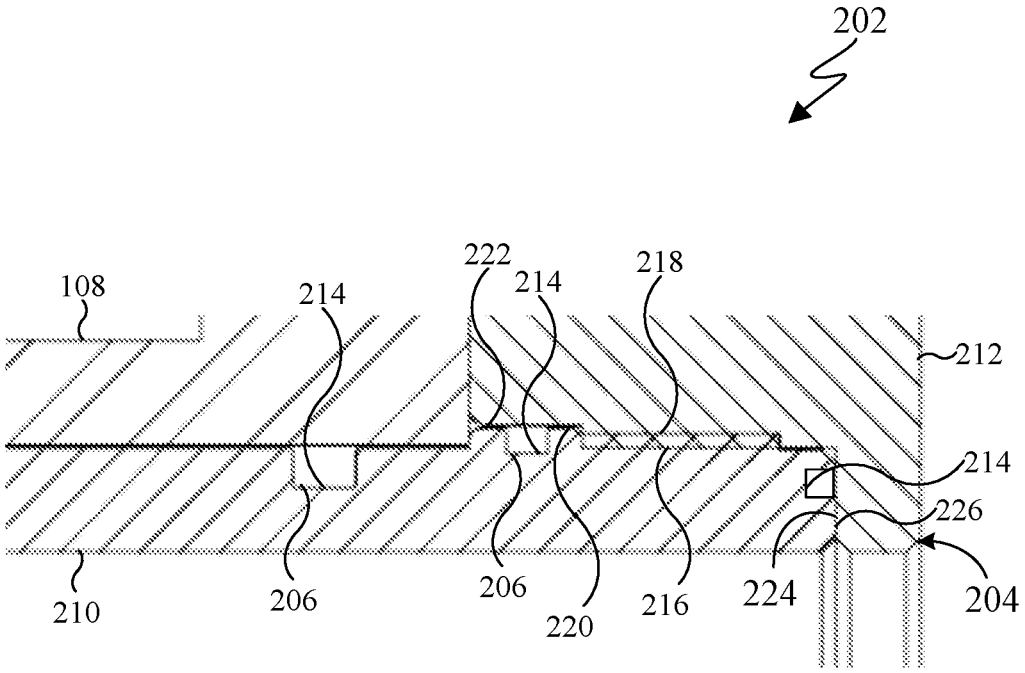

FIGS. 2A through 2C illustrate an exemplary RCD assembly 200 in accordance with this disclosure. In particular, FIG. 2A illustrates RCD assembly 200, FIG. 2B illustrates an upstream seal area 201 between the neck 108 and wear insert 210 for RCD assembly 200, and FIG. 2C illustrates a downstream seal area 202 between the neck 108 and the wear insert 210 of RCD assembly 200. The embodiments of the RCD assembly 200 illustrated in FIGS. 2A through 2C are for illustration only. FIGS. 2A through 2C do not limit the scope of this disclosure to any particular implementation of an RCD assembly.

As shown in FIGS. 2A through 2C, an RCD assembly 200 is designed to reduce wear on a downstream neck 108 of an RCD 102 by covering the exposed surfaces of the interior of the downstream neck 108 with a rotating wear sleeve. The RCD assembly 200 includes an RCD 102, a rotatable wear sleeve 204, and a plurality of seals 206. The wear sleeve 204 can be combined with the RCD 102 by inserting the wear insert 210 into the downstream neck 108. Retainer bolts 126 can be inserted through retainer holes 116 in the retainer flange 212 and into securing hole 128 of flange of the downstream neck 108. The rotating of the retainer bolt 126 causes the retainer flange 212 to abut the flange 124 of the downstream neck 108. In certain embodiments, a seal 130 can be positioned between the retainer flange 212 and the neck flange 124. Once the retainer flange 212 abuts the neck flange 124, the retainer bolts 126 maintain the contact. In certain embodiments, the seal(s) 206 can be formed of a natural or synthetic elastomeric material. In other embodiments, the seal(s) can be formed of metal, plastic, or other sealing materials.

FIG. 2B shows a detailed view of upstream seal area 201 between the wear insert 210 and the downstream neck 108. An outer circumferential surface of the wear insert 210 can include one or more recesses 214 to accommodate one or more ring seals 206. The seals 206 can be compressed between the wear insert 210 and the downstream neck 108 to not allow fluids to travel between the wear insert 210 and the downstream neck and out any spaces between the retainer flange 212 and the neck flange 124. In certain embodiments, multiple seals 206 can be used for the upstream seal area 201, where high fluid erosive flows are experienced. The seals 206 can be manufactured with any shape or material.

FIG. 2C shows a detailed view of a downstream seal area 202 between the wear insert 210 and the downstream neck 108. The downstream seal area 202 of the wear insert 210 can also include one or more additional seal recesses 214 to accommodate one or more ring seals 206. The additional ring seals 206 at the downstream seal area 202 can provide additional sealing capabilities for the connections between the retainer flange 212 and the neck flange 124.

FIG. 2C also shows a connection between the retainer flange 212 and the wear insert 210. The wear insert 210 can include a threaded portion 216 and the retainer flange 212 can include a threaded portion 218 to align with the threaded portion 216. Prior to inserting the wear sleeve 204 into the RCD 102, the wear insert 210 can be rotatable coupled to the retainer flange 212 using the threaded portions 216, 218. The retainer flange 212 can include a retainer recess 220 that corresponds to an insert protrusion 222 formed on the wear insert 210. The insert protrusion 222 abuts the retainer recess 220 when the wear insert 210 is fully coupled to the retainer flange 212.

The retainer flange 212 can also include a retainer lip 224 that extends to an interior of the opening of the retainer flange 212. The retainer lip 224 can extend a distance from the threaded portion 218 of the retainer flange 212 up to a thickness of the wear insert 210. An end portion 226 of the wear insert 210 abuts the inside surface of the retainer lip 224 when the wear insert 210 is fully coupled with the retainer flange 212 using the threaded portions 216, 218.

The insert protrusion 222 and the end portion 226 of the wear insert 210 can also include seal recesses 214 to accommodate a ring seal 206. The ring seals 206 included in a seal recess 214 at the insert protrusion 222 or the end portion 226 can seal the contact between the wear insert 210 and the retainer flange 212 from fluid erosive flows escaping between the retainer flange 212 and the neck flange 124.

Although FIGS. 2A through 2C illustrate an RCD assembly, various changes may be made to FIGS. 2A through 2C. For example, the sizes, shapes, and dimensions of the RCD assembly 200 and its individual components can vary as needed or desired. Also, the number and placement of various components of the RCD assembly 200 can vary as needed or desired. In addition, the RCD assembly 200 may be used in any other suitable process and is not limited to the specific processes described above.

Figure 3A:
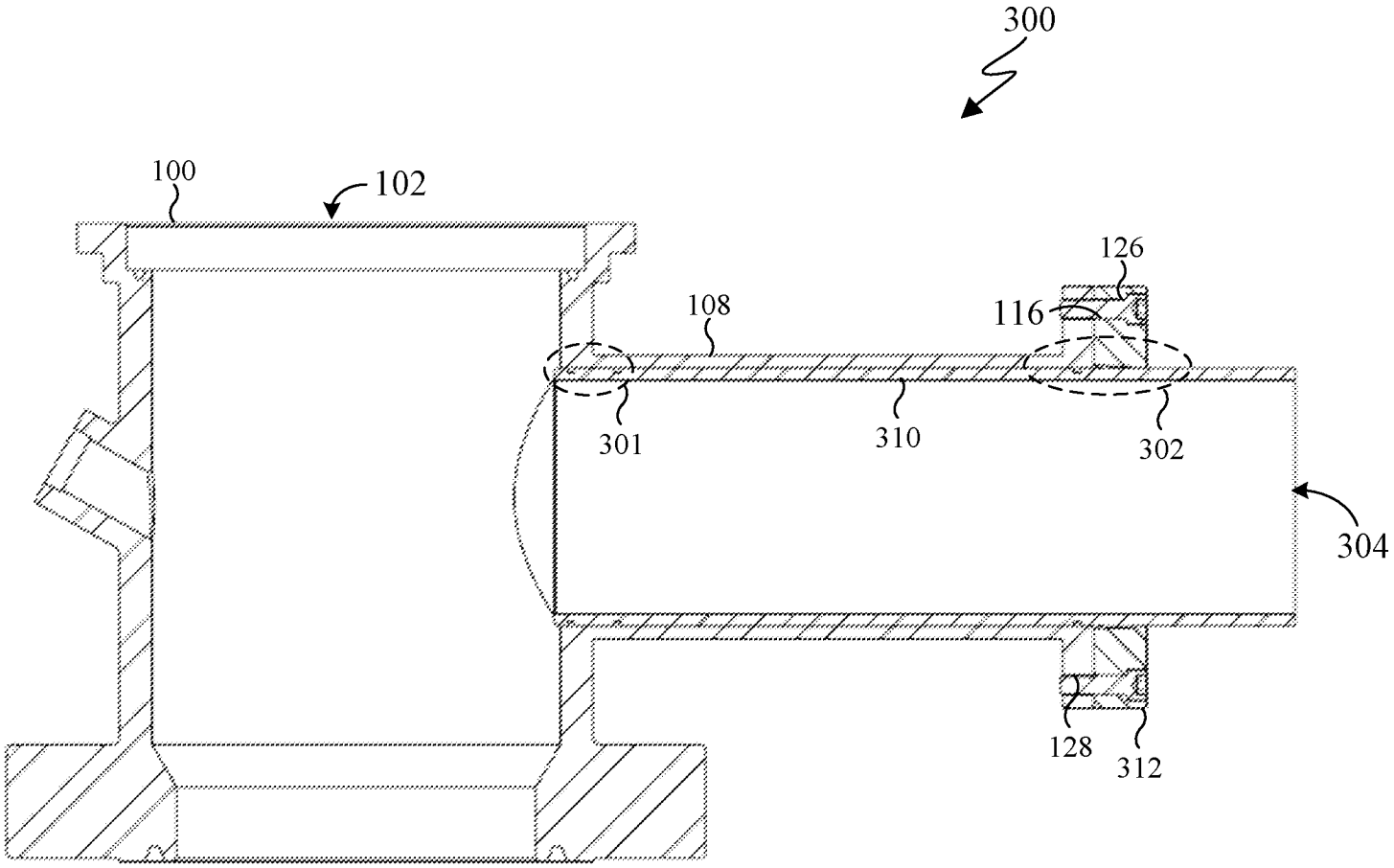
FIGS. 3A through 3C illustrate a second RCD assembly including another rotatable wear sleeve in accordance with this disclosure.
Figure 3B:
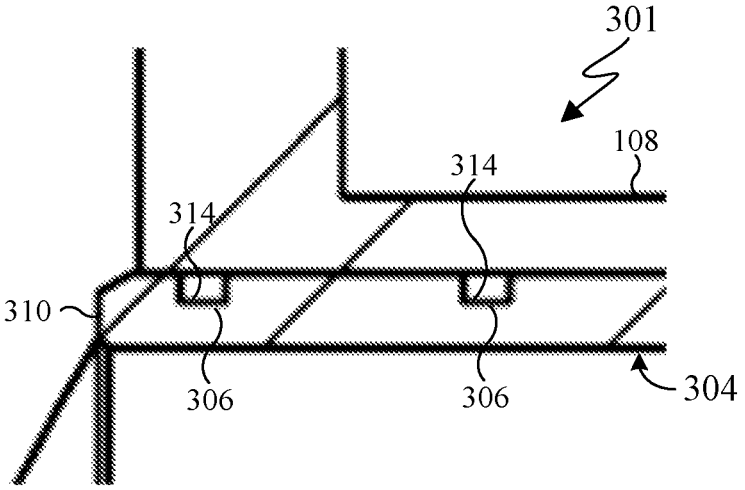
Figure 3C:
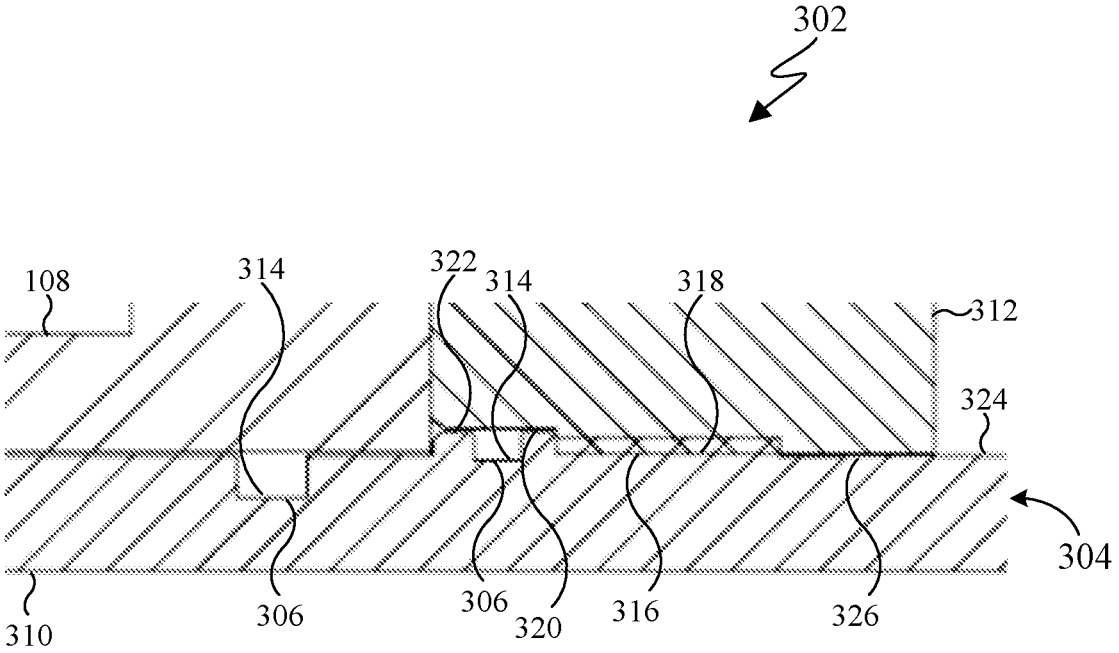

FIGS. 3A through 3C illustrate an exemplary RCD assembly 300 in accordance with this disclosure. In particular, FIG. 3A illustrates RCD assembly 300, FIG. 3B illustrates an upstream seal area 301 between the neck 108 and wear insert 310 for RCD assembly 300, and FIG. 3C illustrates a downstream seal area 302 between the neck 108 and the wear insert 310 of RCD assembly 300. The embodiments of the RCD assembly 300 illustrated in FIGS. 3A through 3C are for illustration only. FIGS. 3A through 3C do not limit the scope of this disclosure to any particular implementation of an RCD assembly.

As shown in FIGS. 3A through 3C, a second RCD assembly 300 is designed for reducing wear on a downstream neck 108 of an RCD 102 by covering exposed surfaces of the interior of the downstream neck 108 with a rotatable wear sleeve. The RCD assembly 300 includes an RCD 102, a rotatable wear sleeve 304, and a plurality of seals 306. The wear sleeve 304 can be combined with the RCD 102 by inserting the wear insert 310 into the downstream neck 108. Retainer bolts 126 can be inserted through retainer holes 116 in the retainer flange 312 and into securing hole 128 of flange of the downstream neck 108. The rotating of the retainer bolt 126 causes the retainer flange 312 to abut the flange 124 of the downstream neck 108. In certain embodiments, a seal can be positioned between the retainer flange 312 and the neck flange 124. Once the retainer flange 312 abuts the neck flange 124, the retainer bolts 126 maintain the contact.

The RCD assembly 300 includes a rotatable wear sleeve that extends from both sides of the retainer flange 312. The RCD assembly 300 does not have the retainer flange 312 exposed to the erosive flow through the RCD 102 and the wear insert 310. The wear insert 310 can extend into the piping connected to the RCD 102 opposite to the retainer flange 312 to provide additional wear protection for the downstream piping or component.

FIG. 3B shows a detailed view of upstream seal area 301 between the wear insert 310 and the downstream neck 108. An outer circumferential surface of the wear insert 310 can include one or more recesses 314 to accommodate one or more ring seals 306. The seals 306 can be compressed between the wear insert 310 and the downstream neck 108 to not allow fluids to travel between the wear insert 310 and the downstream neck and out any spaces between the retainer flange 312 and the neck flange 124. In certain embodiments, multiple seals 306 can be used for the upstream seal area 301, where high fluid erosive flows are experienced. The seals 306 can be manufactured with any shape or material. In certain embodiments, the seal(s) 306 can be formed of a natural or synthetic elastomeric material. In other embodiments, the seal(s) 306 can be formed of metal, plastic, or other sealing materials.

FIG. 3C shows a detailed view of a downstream seal area 302 between the wear insert 310 and the downstream neck 108. The downstream seal area 302 of the wear insert 310 can also include one or more additional seal recesses 314 to accommodate one or more ring seals 306. The additional ring seals 306 at the downstream seal area 302 can provide additional sealing capabilities for the connections between the retainer flange 312 and the neck flange 124.

FIG. 3C also shows a connection between the retainer flange 312 and the wear insert 310. The wear insert 310 can include a threaded portion 316 and the retainer flange 312 can include a threaded portion 318 to align with the threaded portion 316. The threaded portion can be formed at a central portion along the length of the wear insert 310 in order to have an extension portion that extends past the retainer flange 312. In other words, the wear insert 310 extends from both sides of the retainer flange 312. Prior to inserting the wear sleeve 304 into the RCD 102, the wear insert 310 can be rotatable coupled to the retainer flange 312 using the threaded portions 316, 318. The retainer flange 312 can include a retainer recess 320 that corresponds to an insert protrusion 322 formed on the wear insert 310. The insert protrusion 322 abuts the retainer recess 320 when the wear insert 310 is fully coupled to the retainer flange 312.

The insert protrusion 322 or the extension portion 324 of the wear insert 310 can also include one or more seal recesses 314 to accommodate a ring seal 306. The ring seals 306 included in a seal recess 314 at the insert protrusion 322 or the extension portion 324 can seal the contact between the wear insert 310 and the retainer flange 312 from fluid erosive flows escaping between the retainer flange 312 and the neck flange 124. The wear insert 310 and the retainer flange 312 have a flush contact 326 point on an opposite side of the threaded portions 316, 318 from the insert protrusion 322. The flush contact 326 can also include one or more seal recesses 314, as well as the extension portion past the flush contact 326 can also include one or more seal recesses 314.

Although FIGS. 3A through 3C illustrate an RCD assembly, various changes may be made to FIGS. 3A through 3C. For example, the sizes, shapes, and dimensions of the RCD assembly 300 and its individual components can vary as needed or desired. Also, the number and placement of various components of the RCD assembly 300 can vary as needed or desired. In addition, the RCD assembly 300 may be used in any other suitable process and is not limited to the specific processes described above.

Figure 4A:
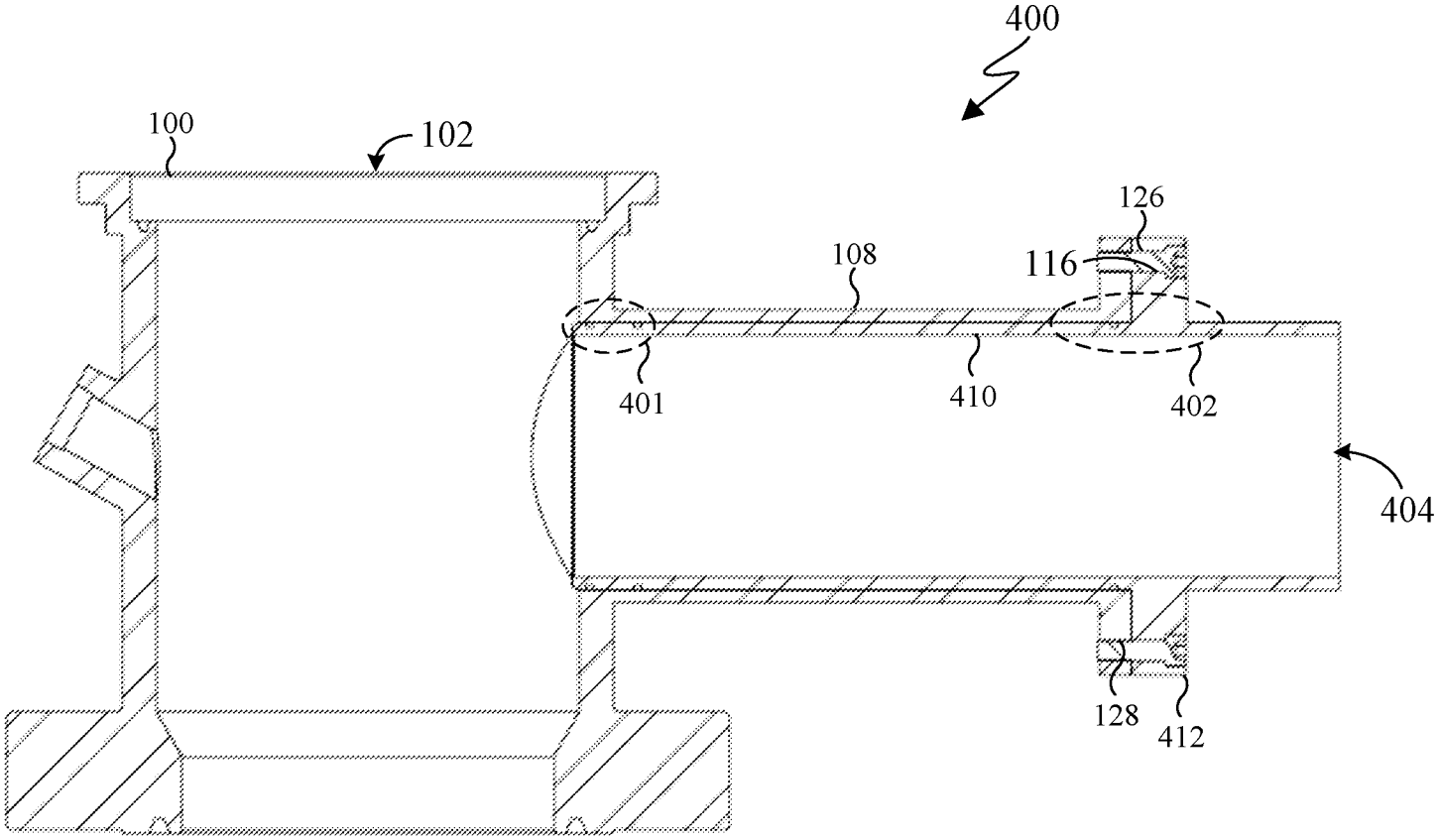
FIGS. 4A through 4C illustrate a third RCD assembly including yet another rotatable wear sleeve in accordance with this disclosure.
Figure 4B:
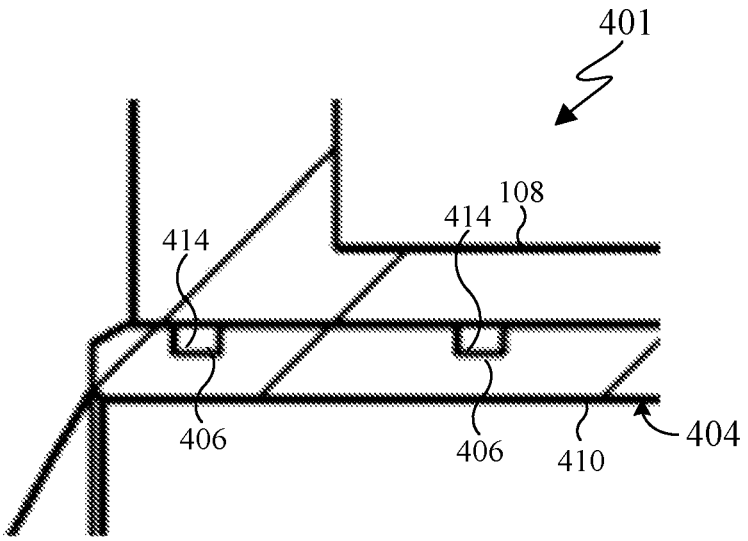
Figure 4C:
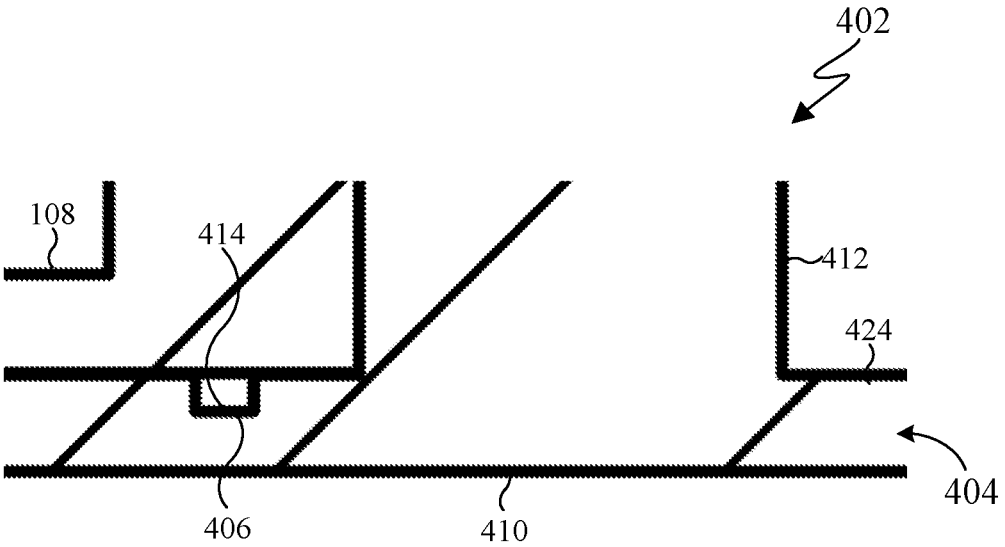

FIGS. 4A through 4C illustrate an exemplary RCD assembly 400 in accordance with this disclosure. In particular, FIG. 4A illustrates RCD assembly 400, FIG. 4B illustrates an upstream seal area 401 between the downstream neck 108 and wear insert 410 for RCD assembly 400, and FIG. 4C illustrates a downstream seal area 402 between the downstream neck 108 and the wear insert 410 of RCD assembly. The embodiments of the RCD assembly 400 illustrated in FIGS. 4A through 4C are for illustration only. FIGS. 4A through 4C do not limit the scope of this disclosure to any particular implementation of an RCD assembly.

As shown in FIGS. 4A through 4C, an RCD assembly 400 is designed for reducing wear on a downstream neck 108 of an RCD 102 by covering the exposed surfaces of the interior of the downstream neck 108 with a rotatable wear sleeve. The RCD assembly 400 includes an RCD 102, a rotatable wear sleeve 404, and a plurality of seals 406. The wear sleeve 404 can be combined with the RCD 102 by inserting the wear insert 410 into the downstream neck 108. Retainer bolts 126 can be inserted through retainer holes 116 in the retainer flange 412 and into securing hole 128 of flange of the downstream neck 108. The rotating of the retainer bolt 126 causes the retainer flange 412 to abut the neck flange 124 of the downstream neck 108. In certain embodiments, a seal can be positioned between the retainer flange 412 and the neck flange 124. Once the retainer flange 412 abuts the neck flange 124, the retainer bolts 126 maintain the contact.

The wear sleeve 404 can be formed with the retainer flange 412 integral to the wear insert 410. Forming an integrated wear insert 410 with the retainer flange 412 can reduce the complexity of the assembly. However, using a retainer flange 412 with the wear insert 410 requires that the retainer flange 412 also be replaced when the wear insert 410 is to be replaced. In certain embodiments, the cost to replace the retainer flange 412 might be inconsequential compared to design and forming of the connections between a retainer flange and a wear insert.

FIG. 4B shows a detailed view of upstream seal area 401 between the wear insert 410 and the downstream neck 108. An outer circumferential surface of the wear insert 410 can include one or more recesses 414 to accommodate one or more ring seals 406. The seals 406 can be compressed between the wear insert 410 and the downstream neck 108 to not allow fluids to travel between the wear insert 410 and the downstream neck and out any spaces between the retainer flange 412 and the neck flange 124. In certain embodiments, multiple seals 406 can be used for the upstream seal area 401, where high fluid erosive flows are experienced. The seals 406 can be manufactured with any shape or material. In certain embodiments, the seal(s) 406 can be formed of a natural or synthetic elastomeric material. In other embodiments, the seal(s) 406 can be formed of metal, plastic, or other sealing materials.

FIG. 4C shows a detailed view of a downstream seal area 402 between the wear insert 410 and the downstream neck 108. The downstream seal area 402 of the wear insert 410 can also include one or more additional seal recesses 414 to accommodate one or more ring seals 406. The additional ring seals 406 at the downstream seal area 402 can provide additional sealing capabilities for the connections between the retainer flange 412 and the neck flange 124.

FIG. 4C also shows a detailed view of the integration of the retainer flange 412 and the wear insert 410. The wear insert 410 can include an extension portion 424. The extension portion 424 can extend from the retainer flange 412. In certain embodiments, the extension portion 424 can extend a same length from the retainer flange 412 as the portion of the wear insert 410 extends into the downstream neck 108. This would allow for standardization of components and also would allow the wear sleeve 404 to be reverses in addition to being rotatable. The extension portion 424 can include one or more seal recesses 414 in a similar number and placement as the portion contacting the downstream neck 108 or have a different number and placement designed for specific piping or components to be attached to the neck flange 124. In certain embodiments, the thickness of the extension portion 424 could be reduced compared to a thickness of the portion that is upstream in contact with the downstream neck 108. For example, when the extension portion is designed for a downstream piping and not to be reversible, the pressure erosive flows might not create as excessive wear as the wear insert 410 at the upstream seal area 401. Thus, the thickness of the extension portion 424 could be reduced for cost and material saving. Also, the rotation indicators 122 can be implemented on both sides of the retainer flange 112 or retainer flange 412 to accommodate the reversable position of the RCD assembly 400.

Although FIGS. 4A through 4C illustrate an RCD assembly, various changes may be made to FIGS. 4A through 4C. For example, the sizes, shapes, and dimensions of the RCD assembly 400 and its individual components can vary as needed or desired. Also, the number and placement of various components of the RCD assembly 400 can vary as needed or desired. In addition, the RCD assembly 400 may be used in any other suitable process and is not limited to the specific processes described above.

Figure 5A:
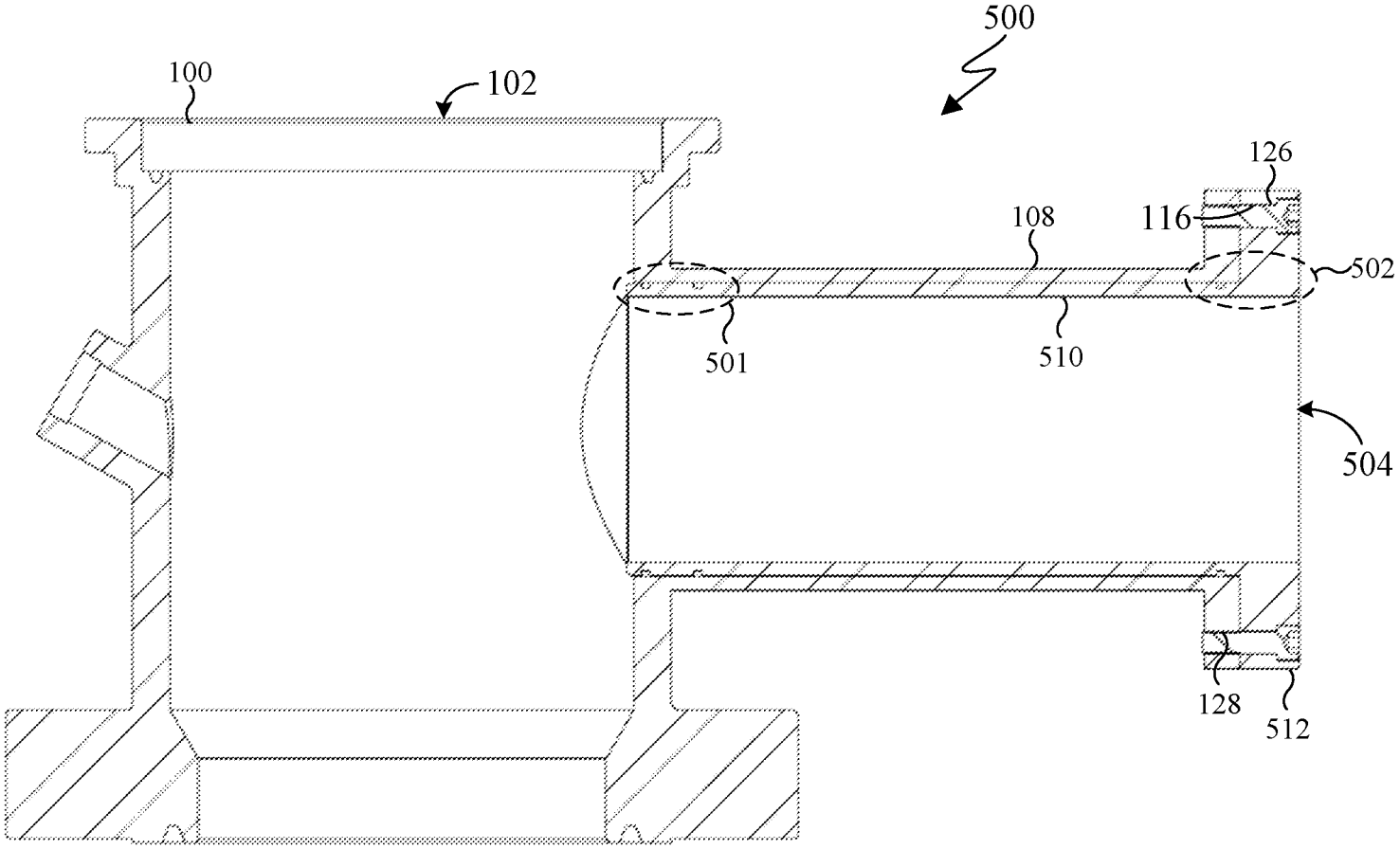
FIGS. 5A through 5C illustrate a fourth RCD assembly including still another rotatable wear sleeve in accordance with this disclosure.
Figure 5B:
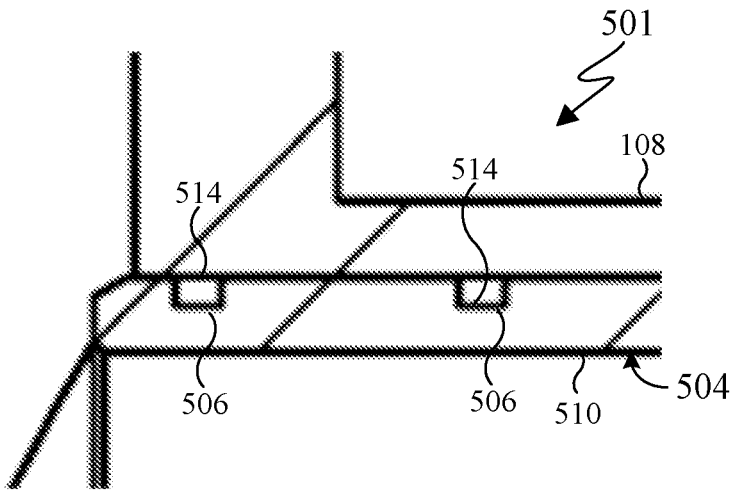
Figure 5C:
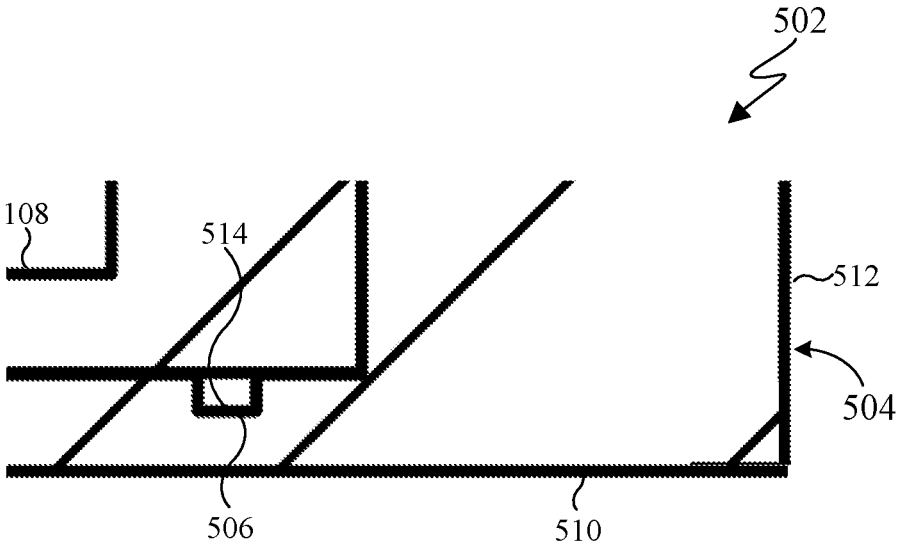

FIGS. 5A through 5C illustrate an exemplary RCD assembly 500 in accordance with this disclosure. In particular, FIG. 5A illustrates RCD assembly 500, FIG. 5B illustrates an upstream seal area 501 between the neck 108 and wear insert 510 for RCD assembly 500, and FIG. 5C illustrates a downstream seal area 502 between the neck 108 and the wear insert 510 of RCD assembly. The embodiments of the RCD assembly 500 illustrated in FIGS. 5A through 5C are for illustration only. FIGS. 5A through 5C do not limit the scope of this disclosure to any particular implementation of an RCD assembly.

As shown in FIGS. 5A through 5C, an RCD assembly 500 is designed to reduce wear on a downstream neck 108 of an RCD 102 by covering the exposed surfaces of the interior of the downstream neck 108 with a rotatable wear sleeve. The RCD assembly 500 includes an RCD 102, a rotatable wear sleeve 504, and a plurality of seals 506. The wear sleeve 504 can be combined with the RCD 102 by inserting the wear insert 510 into the downstream neck 108. Retainer bolts 126 can be inserted through retainer holes 116 in the retainer flange 512 and into securing hole 128 of flange of the downstream neck 108. The rotating of the retainer bolt 126 causes the retainer flange 512 to abut the neck flange 124 of the downstream neck 108. In certain embodiments, a seal can be positioned between the retainer flange 512 and the neck flange 124. Once the retainer flange 512 abuts the neck flange 124, the retainer bolts 126 maintain the contact. The wear sleeve 404 can be formed with the retainer flange 412 integral to the wear insert 410. Forming an integrated wear insert 410 with the retainer flange 412 can reduce the complexity of the assembly. However, using a retainer flange 412 with the wear insert 410 requires that the retainer flange 412 also be replaced when the wear insert 410 is to be replaced. In certain embodiments, the cost to replace the retainer flange 412 might be inconsequential compared to design and forming of the connections between a retainer flange and a wear insert.

FIG. 5B shows a detailed view of upstream seal area 501 between the wear insert 510 and the downstream neck 108. An outer circumferential surface of the wear insert 510 can include one or more recesses 514 to accommodate one or more ring seals 506. The seals 506 can be compressed between the wear insert 510 and the downstream neck 108 to not allow fluids to travel between the wear insert 510 and the downstream neck and out any spaces between the retainer flange 512 and the neck flange 124. In certain embodiments, multiple seals 506 can be used for the upstream seal area 501, where high fluid erosive flows are experienced. The seals 506 can be manufactured with any shape or material. In certain embodiments, the seal(s) 506 can be formed of a natural or synthetic elastomeric material. In other embodiments, the seal(s) 506 can be formed of metal, plastic, or other sealing materials.

FIG. 5C shows a detailed view of a downstream seal area 502 between the wear insert 510 and the downstream neck 108. The downstream seal area 502 of the wear insert 510 can also include one or more additional seal recesses 514 to accommodate one or more ring seals 506. The additional ring seals 506 at the downstream seal area 502 can provide additional sealing capabilities for the connections between the retainer flange 512 and the neck flange 124.

Although FIGS. 5A through 5C illustrate an RCD assembly, various changes may be made to FIGS. 5A through 5C. For example, the sizes, shapes, and dimensions of the RCD assembly 500 and its individual components can vary as needed or desired. Also, the number and placement of various components of the RCD assembly 500 can vary as needed or desired. In addition, the RCD assembly 500 may be used in any other suitable process and is not limited to the specific processes described above.

Figure 6A:
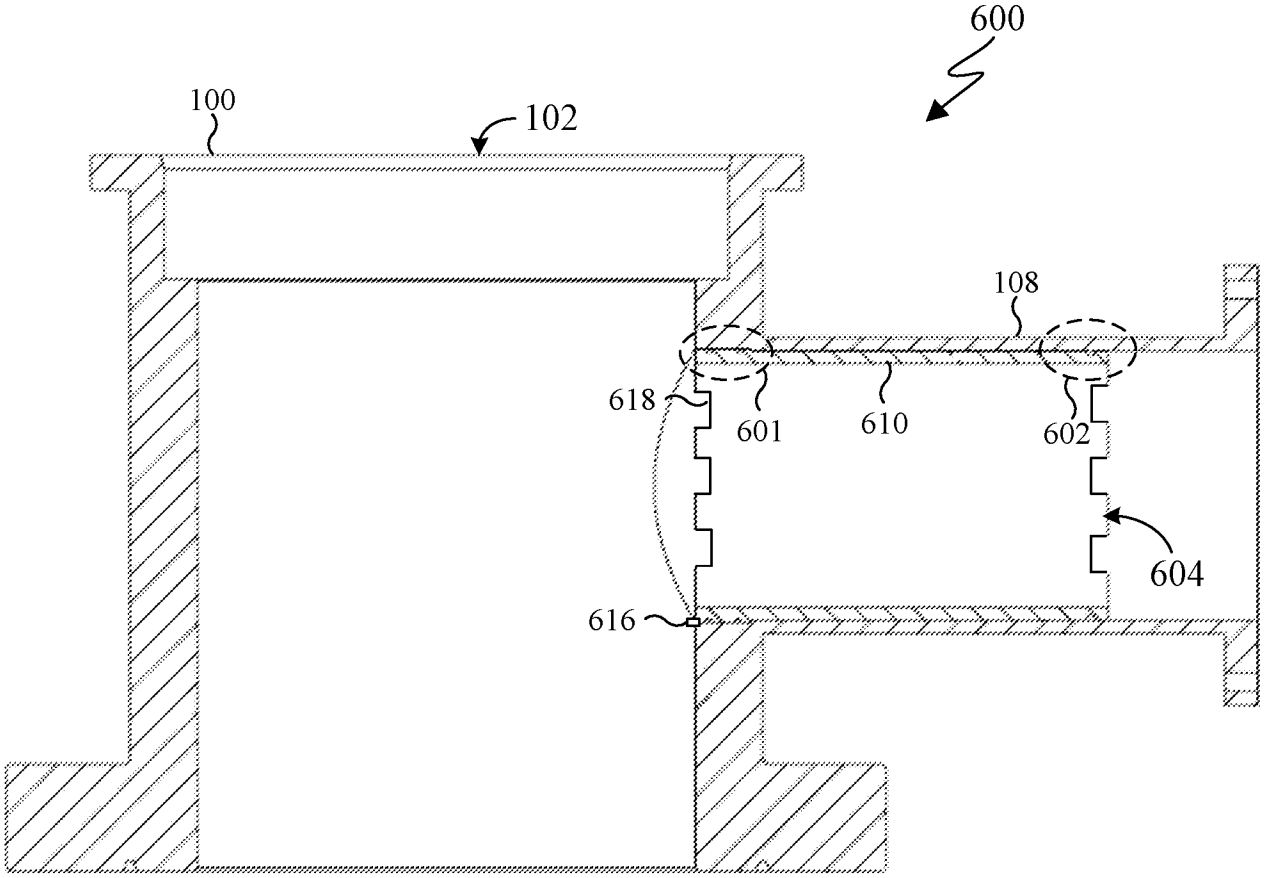
FIGS. 6A through 6C illustrate a fifth RCD assembly including a further rotatable wear sleeve in accordance with this disclosure.
Figure 6B:
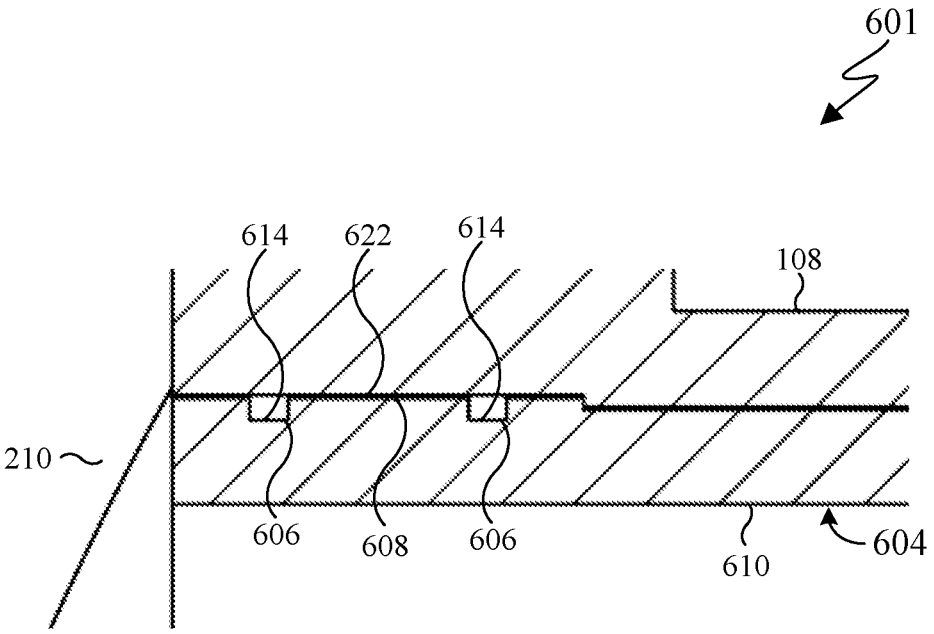
Figure 6C:
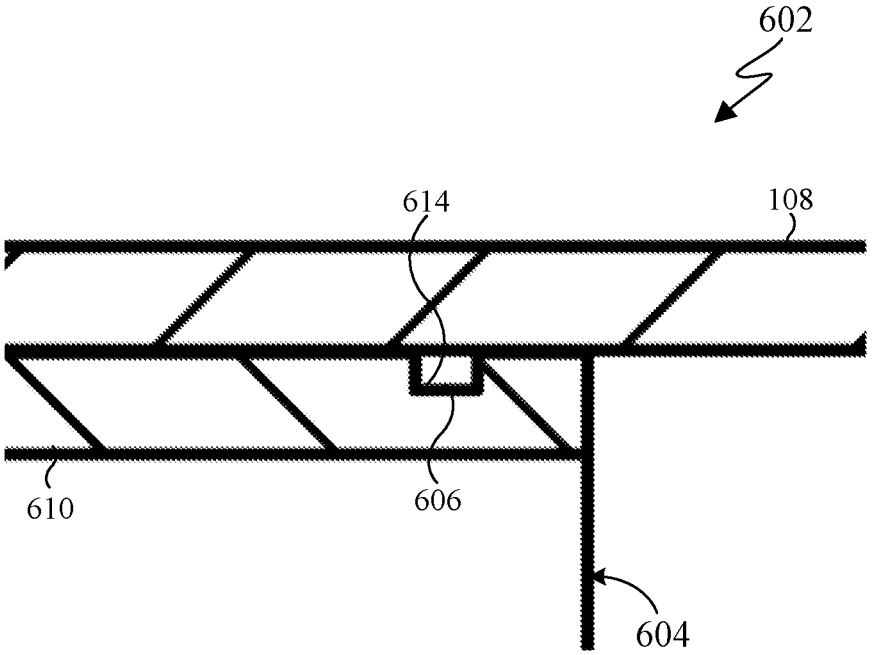

FIGS. 6A through 6C illustrate an exemplary RCD assembly 600 in accordance with this disclosure. In particular, FIG. 6A illustrates RCD assembly 600, FIG. 6B illustrates RCD an upstream seal area 601 between the neck 108 and wear insert 610 for assembly 600, and FIG. 6C illustrates a downstream seal area 602 between the neck 108 and the wear insert 610 of RCD assembly 600. The embodiments of the RCD assembly 600 illustrated in FIGS. 6A through 6C are for illustration only. FIGS. 6A through 6C do not limit the scope of this disclosure to any particular implementation of an RCD assembly.

As shown in FIGS. 6A through 6C, an RCD assembly 600 is designed to reduce wear on a downstream neck 108 of an RCD 102 by covering exposed surfaces of the interior of the downstream neck 108 with a rotatable wear sleeve. The RCD assembly 600 includes an RCD 102, a rotatable wear sleeve 604, and a plurality of seals 606. The wear sleeve 604 can be combined with the RCD 102 by inserting the wear insert 610 into the downstream neck 108. The wear sleeve 104 in this embodiment does not include a retainer flange. The wear sleeve 104 can be inserted into the downstream neck 108 through an opening of the housing 106. The RCD assembly 600 can also include one or more grub screws 616 used to fix the wear insert in the RCD 102. In some embodiments, the wear sleeve 604 may cover the entire interior surface of the downstream neck 108, while in other embodiments the wear sleeve may only cover portions of the downstream neck.

The wear insert 610 can also include notches 618 used to rotate the wear insert 610 within the downstream neck 108. The notches 618 can extend around a circumference at one or both ends of the wear insert 610. The notches 618 can be shaped to match with a tool (not shown) having teeth that engage the notches to allow rotation of the wear insert 610.

FIG. 6B shows a detailed view of upstream seal area 601 between the wear insert 610 and the downstream neck 108. An outer circumferential surface of the wear insert 610 can include one or more recesses 614 to accommodate one or more ring seals 606. The seals 606 can be compressed between the wear insert 610 and the downstream neck 108 to not allow fluids to travel between the wear insert 610 and the downstream neck 108 and out any spaces between the retainer flange 612 and the neck flange 124. In certain embodiments, multiple seals 606 can be used for the upstream seal area 601, where high fluid erosive flows are experienced. The seals 606 can be manufactured with any shape or material. In certain embodiments, the seal(s) 606 can be formed of a natural or synthetic elastomeric material. In other embodiments, the seal(s) 606 can be formed of metal, plastic, or other sealing materials. In certain embodiments, the wear insert 610 can be manufactured in the RCD 102.

FIG. 6B also show a fitted connection between the wear insert 610 and the downstream neck 108. As mentioned previously, the wear insert 610 does not include a retainer flange 412. The wear insert 610 has an insert protrusion 622 on an exterior circumference at one end. The wear insert 610 inserted into the downstream neck 108 through an opening of the housing 106. The wear insert is released once the insert protrusion 622 has cleared a neck recess 608. The neck recess 608 is a portion of the neck that can be formed or machined (e.g., bored) to have a greater diameter than the downstream portion 302 of the RCD assembly 300. The neck recess 608 couples with the insert protrusion 622 to maintain the position of the wear insert 610 with the interior of the downstream neck 108. The ends of the neck recess 608 and the insert protrusion can have matching tapers, matching changes in diameter, matching edge surfaces, etc.

FIG. 6C shows a detailed view of a downstream seal area 602 between the wear insert 610 and the downstream neck 108. The downstream seal area 602 of the wear insert 610 can also include one or more additional seal recesses 614 to accommodate one or more ring seals 606. The additional ring seals 606 at the downstream seal area 602 can provide additional sealing capabilities for the connections between the retainer flange 612 and the neck flange 124.

Although FIGS. 6A through 6C illustrate a RCD assembly, various changes may be made to FIGS. 6A through 6C. For example, the sizes, shapes, and dimensions of the RCD assembly 600 and its individual components can vary as needed or desired. Also, the number and placement of various components of the RCD assembly 600 can vary as needed or desired. In addition, the RCD assembly 600 may be used in any other suitable process and is not limited to the specific processes described above.

Figure 7A:
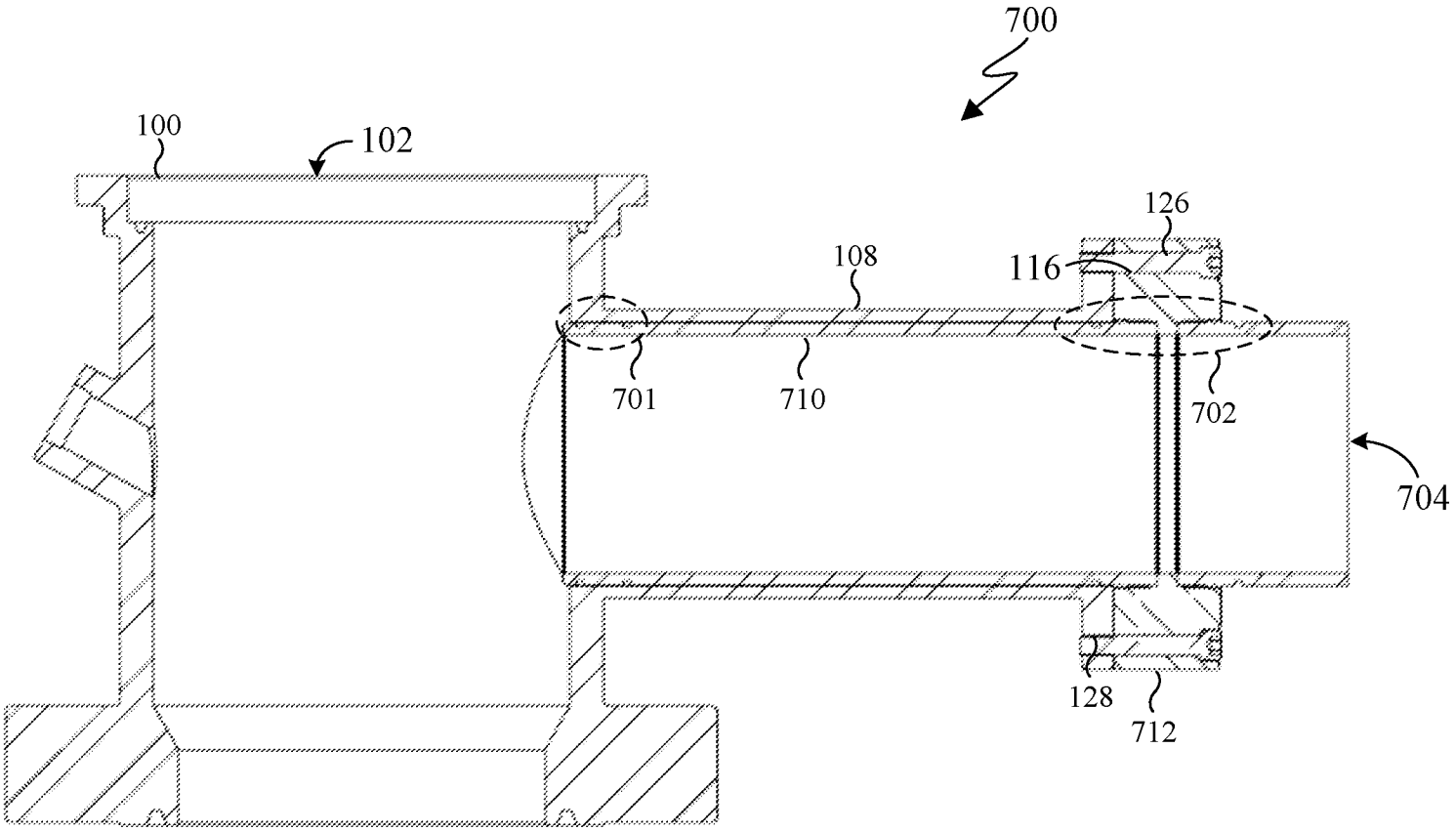
FIGS. 7A through 7C illustrate a sixth RCD assembly including a still further rotatable wear sleeve in accordance with this disclosure.
Figure 7B:
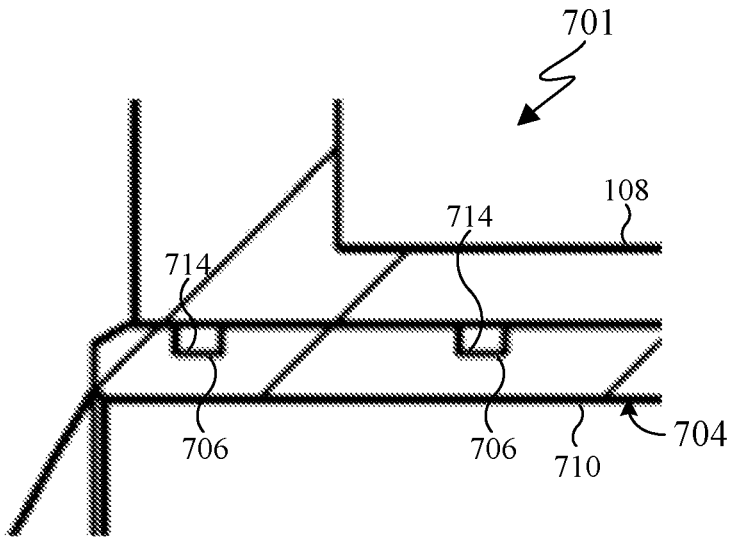
Figure 7C:
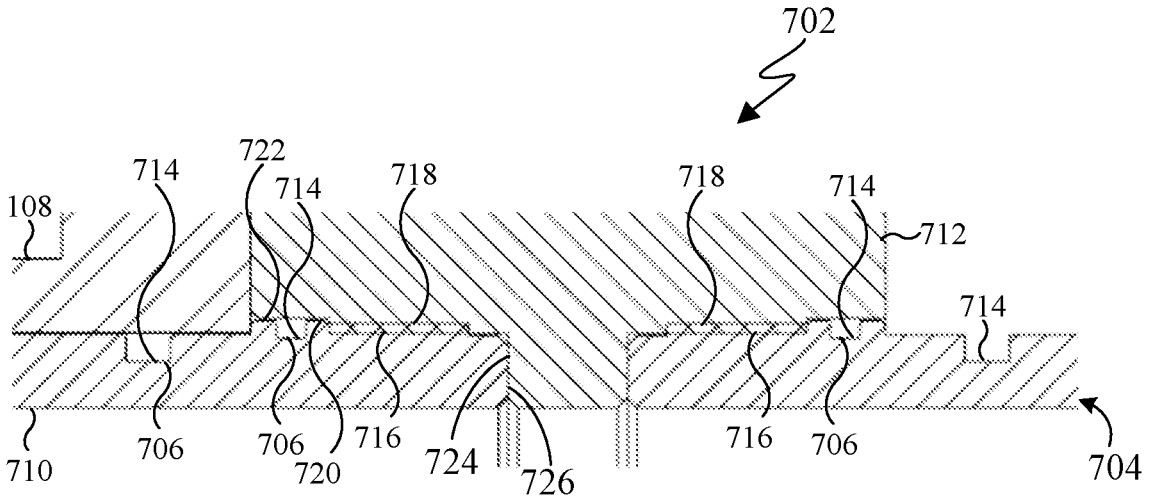

FIGS. 7A through 7C illustrate an exemplary RCD assembly 700 in accordance with this disclosure. In particular, FIG. 7A illustrates RCD assembly 700, FIG. 7B illustrates an upstream seal area 701 between the neck 108 and wear insert 710 for of the RCD assembly 700, and FIG. 7C illustrates a downstream seal area 702 between the neck 108 and the wear insert 710 of RCD assembly 700. The embodiments of the RCD assembly 700 illustrated in FIGS. 7A through 7C are for illustration only. FIGS. 7A through 7C do not limit the scope of this disclosure to any particular implementation of an RCD assembly.

As shown in FIGS. 7A through 7C, As shown in FIGS. 7A through 7C, an RCD assembly 700 is designed for reducing wear on a downstream neck 108 of an RCD 102 by covering the exposed surfaces of the interior of the downstream neck 108 with a rotatable wear sleeve. The RCD assembly 700 includes an RCD 102, a rotatable wear sleeve 704, and a plurality of seals 706. The wear sleeve 704 can be combined with the RCD 102 by inserting the wear insert 710 into the downstream neck 108. Retainer bolts 126 can be inserted through retainer holes 116 in the retainer flange 712 and into securing hole 128 of flange of the downstream neck 108. The rotating of the retainer bolt 126 causes the retainer flange 712 to abut the flange 124 of the downstream neck 108. In certain embodiments, a seal can be positioned between the retainer flange 712 and the neck flange 124. Once the retainer flange 712 abuts the neck flange 124, the retainer bolts 126 maintain the contact.

The retainer flange 712 has connections for first and second wear inserts 710. The first and second wear inserts 710 can be designed the same for simplicity or designed to have different wear inserts 710 for upstream of the retainer flange 712 and downstream of the retainer flange 712. In embodiments where the wear inserts 710 are specifically designed for upstream or downstream of the retainer flange 712, the diameter dimension or length dimension could be different to ensure the correct wear insert 710 is installed on the upstream side and the downstream side of the retainer flange. For example, a wear insert 710 designed for downstream of the retainer flange 712 could have reduced outside diameter corresponding to a smaller thickness required for the reduced fluid erosive flows and general wear. The wear inserts 710 upstream and downstream of the retainer flange can include a same or different amount of seal recesses based on the reduced fluid pressure in the pipe.

FIG. 7B shows a detailed view of upstream seal area 701 between the wear insert 710 and the downstream neck 108. An outer circumferential surface of the wear insert 710 can include one or more recesses 714 to accommodate one or more ring seals 706. The seals 706 can be compressed between the wear insert 710 and the downstream neck 108 to not allow fluids to travel between the wear insert 710 and the downstream neck and out any spaces between the retainer flange 712 and the neck flange 124. In certain embodiments, multiple seals 706 can be used for the upstream seal area 701, where high fluid erosive flows are experienced. The seals 706 can be manufactured with any shape or material. In certain embodiments, the seal(s) 706 can be formed of a natural or synthetic elastomeric material. In other embodiments, the seal(s) 706 can be formed of metal, plastic, or other sealing materials.

FIG. 7C shows a detailed view of a downstream seal area 702 between the first wear insert 710 and the downstream neck 108. The downstream seal area 702 of the wear insert 710 can also each include one or more additional seal recesses 714 to accommodate one or more ring seals 706. The additional ring seals 706 at the downstream seal area 702 can provide additional sealing capabilities for the connections between the retainer flange 712 and the neck flange 124. The same description would apply for the wear insert 710 positioned downstream on the retainer flange 712.

FIG. 7C also shows a connection between the retainer flange 712 and the first and second wear inserts 710. The first and second wear inserts 710 can include a threaded portion 716 and the retainer flange 712 can include a threaded portion 718 to align with the threaded portion 716. Prior to inserting the wear sleeve 704 into the RCD 102, the wear insert 710 can be rotatable coupled to the retainer flange 712 using the threaded portions 716, 718. The retainer flange 712 can include a retainer recess 720 that corresponds to an insert protrusion 722 formed on the wear insert 710. The insert protrusion 722 abuts the retainer recess 720 when the wear insert 710 is fully coupled to the retainer flange 712.

The retainer flange 712 can also include a retainer lip 724 that extends to an interior of the opening of the retainer flange 712. The retainer lip 724 can extend a distance from the threaded portion 718 of the retainer flange 712 up to a thickness of the wear insert 710. An end portion 726 of the wear insert 710 abuts the inside surface of the retainer lip 724 when the wear insert 710 is fully coupled with the retainer flange 712 using the threaded portions 716, 718. While both the upstream and downstream wear insert 710 are showed using the same connection, any combination of previous embodiments is possible for use with the retainer flange 712. For instance, the downstream wear insert 710 could be integral with the retainer flange 712 and only the upstream wear insert could be replaceable through the threaded portions 716, 718.

The insert protrusion 722 and the end portion 726 of the wear insert 710 can also include seal recesses 714 to accommodate a ring seal 706. The ring seals 706 included in a seal recess 714 at the insert protrusion 722 or the end portion 726 can seal the contact between the wear insert 710 and the retainer flange 712 from fluid erosive flows escaping between the retainer flange 712 and the neck flange 124. The amount of placement of the seal recesses can be uniform for the upstream and downstream wear inserts 710 or different for each of the upstream and downstream wear inserts 710.

Although FIGS. 7A through 7C illustrate an RCD assembly, various changes may be made to FIGS. 7A through 7C. For example, the sizes, shapes, and dimensions of the RCD assembly 700 and its individual components can vary as needed or desired. Also, the number and placement of various components of the RCD assembly 700 can vary as needed or desired. In addition, the RCD assembly 700 may be used in any other suitable process and is not limited to the specific processes described above.

Figure 8A:
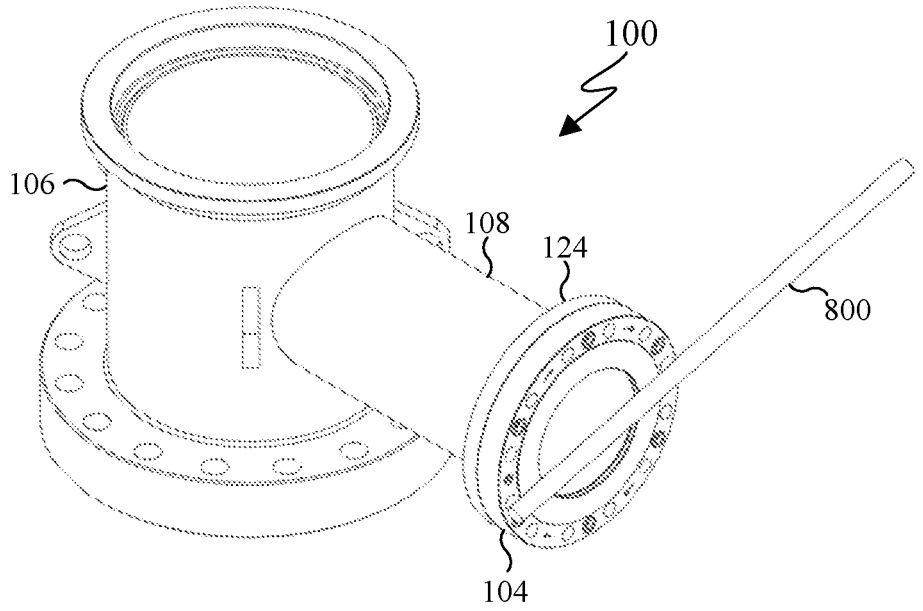
FIGS. 8A and 8B illustrate an RCD spanner tool in accordance with this disclosure.
Figure 8B:
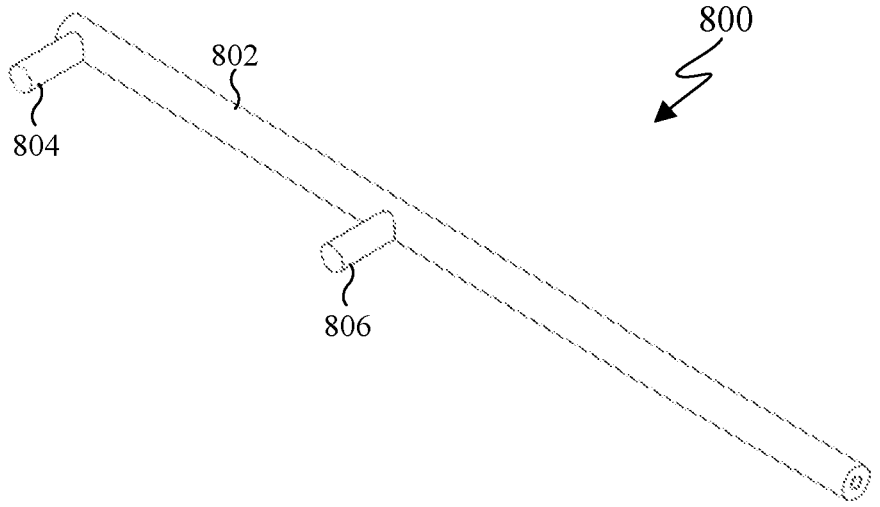

FIGS. 8A and 8B illustrate an RCD spanner tool 800 in accordance with this disclosure. In particular, FIG. 8A illustrates RCD spanner tool 800 attached to an RCD assembly 100, and FIG. 8B illustrates RCD spanner tool 800. The embodiments of the RCD spanner tool 800 illustrated in FIGS. 8A and 8B are for illustration only. FIGS. 8A and 8B do not limit the scope of this disclosure to any particular implementation of an RCD spanner tool. While the RCD spanner tool 800 is illustrated attached to RCD assembly 100, the RCD spanner tool 800 can be used with any of RCD assemblies 100-700.

As shown in FIGS. 8A and 8B, a spanner tool 800 can be used to rotate the RCD assembly 100. The spanner tool 800 include a torque bar 802, a first protrusion 804, and a second protrusion 806. The torque bar 802 is designed with a length that allows a user to rotate the wear sleeve 104 without full removal from the downstream neck 108. The torque bar 802 includes a first protrusion 804 located at an end and a second protrusion 806 positioned at an intermediate location of the torque bar 802. The distance between the first protrusion 804 and the second protrusion 806 is equal to through holes 114 that are located opposite on the retainer flange 112 from a center point of the opening of the retainer flange 112. The first protrusion 804 and the second protrusion 806 can be the same diameter and length or can have different dimensions. The first protrusion 804 and the second protrusion 806 can have a diameter and length to fit within the standard through holes 114, the retainer holes 116, or the release threaded holes.

Although FIGS. 8A and 8B illustrate a RCD spanner tool, various changes may be made to FIGS. 8A and 8B. For example, the sizes, shapes, and dimensions of the RCD spanner tool 800 and its individual components can vary as needed or desired. Also, the number and placement of various components of the RCD spanner tool 800 can vary as needed or desired. In addition, the RCD spanner tool 800 may be used in any other suitable process and is not limited to the specific processes described above.

Figure 9A:
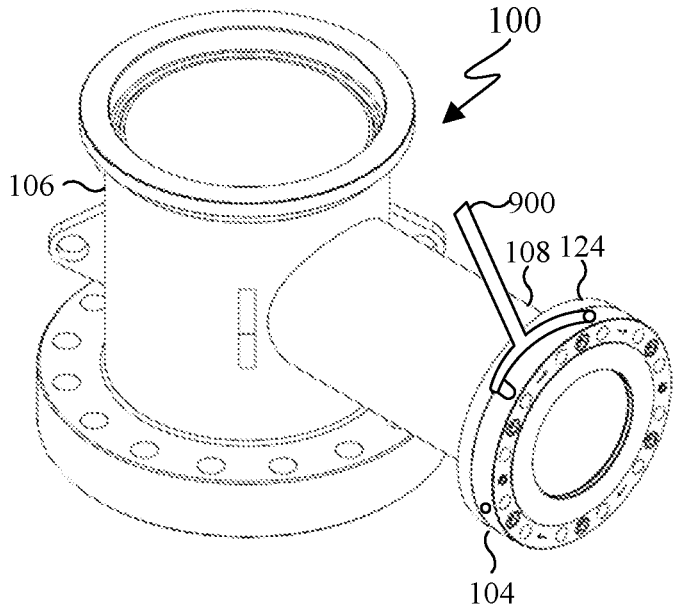
FIGS. 9A and 9B illustrate another RCD spanner tool in accordance with this disclosure.
Figure 9B:
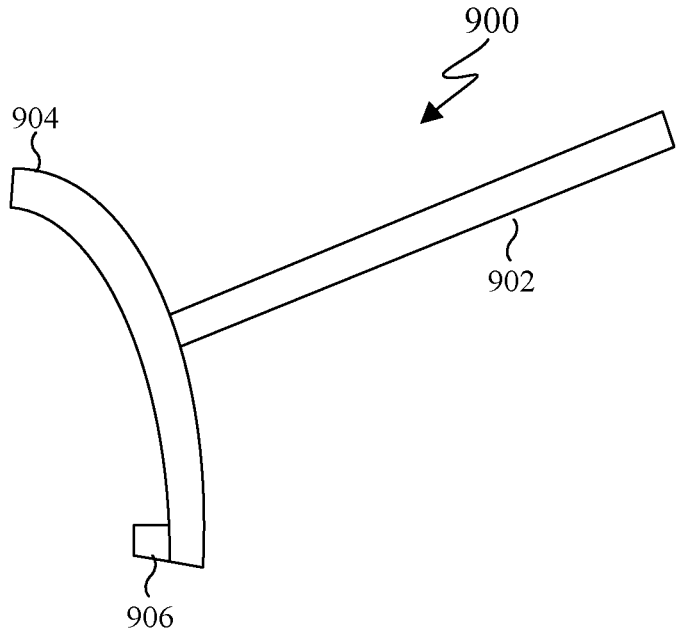

FIGS. 9A and 9B illustrate another RCD spanner tool 900 in accordance with this disclosure. In particular, FIG. 9A illustrates RCD spanner tool 900 attached to an RCD assembly 100, and FIG. 9B illustrates RCD spanner tool 900. The embodiments of the RCD spanner tool 900 illustrated in FIGS. 9A and 9B are for illustration only. FIGS. 9A and 9B do not limit the scope of this disclosure to any particular implementation of an RCD spanner tool. While the RCD spanner tool 900 is illustrated attached to RCD assembly 100, the RCD spanner tool 900 can be used with any of RCD assemblies 100-700.

As shown in FIGS. 9A and 9B, a spanner tool 900 can be used to rotate the RCD assembly 100. The spanner tool 900 include a torque bar 902, a grip bar 904, and a protrusion 906 906. The torque bar 902 is designed with a length that allows a user to rotate the wear sleeve 104 without full removal from the downstream neck 108. The torque bar 902 includes a grip bar 904 located at an end of the torque bar 902. The torque bar 902 is connected to an intermediate point of the grip bar 904. A protrusion 906 is positioned at an end of the grip bar 904. The length of the grip bar is based on a distance between through holes 114 that are located opposite on the retainer flange 112 from a center point of the opening of the retainer flange 112. The end of the grip bar opposite to the protrusion 906 and the protrusion 906 can be designed with the same diameter and length or can have different dimensions. The other end of the grip bar 904 and the protrusion 906 can have a diameter and length to fit within the standard through holes 114, the retainer holes 116, or the release threaded holes.

Although FIGS. 9A and 9B illustrate a RCD spanner tool, various changes may be made to FIGS. 9A and 9B. For example, the sizes, shapes, and dimensions of the RCD spanner tool 900 and its individual components can vary as needed or desired. Also, the number and placement of various components of the RCD spanner tool 900 can vary as needed or desired. In addition, the RCD spanner tool 900 may be used in any other suitable process and is not limited to the specific processes described above.

It will be appreciated by those skilled in the art having the benefit of this disclosure that this rotatable wear sleeve for wellhead pressure control devices provides a wear sleeve that can be rotated inside after periods of time to allow for even wearing on the wear sleeve. It should be understood that the drawings and detailed description herein are to be regarded in an illustrative rather than a restrictive manner, and are not intended to be limiting to the particular forms and examples disclosed. On the contrary, included are any further modifications, changes, rearrangements, substitutions, alternatives, design choices, and embodiments apparent to those of ordinary skill in the art, without departing from the spirit and scope hereof, as defined by the following claims. Thus, it is intended that the following claims be interpreted to embrace all such further modifications, changes, rearrangements, substitutions, alternatives, design choices, and embodiments.

What is claimed is:

1. A wear sleeve for use with a rotating control device (RCD), the wear sleeve comprising:

a wear insert formed in a tube shape with an outer profile to match an inner profile of a downstream neck of the RCD to be inserted into the downstream neck;

a retainer flange extending from an outer surface of the wear insert to couple with a neck flange at an end of the downstream neck of the RCD; and wherein the retainer flange includes at least two through holes for connecting a tool to rotate the wear sleeve.

2. The wear sleeve of claim 1, wherein:

the retainer flange further includes at least two threaded holes for aligning with securing holes in the neck flange, and at least two retaining bolts inserted through the threaded holes and the securing holes.

3. The wear sleeve of claim 2, wherein the bolts do not interfere with a downstream component connecting to the neck flange using the through holes of the retainer flange.

4. A wear sleeve for use with a rotating control device (RCD), the wear sleeve comprising:

a wear insert formed in a tube shape with an outer profile to match an inner profile of a downstream neck of the RCD to be inserted into the downstream neck; and a retainer flange extending from an outer surface of the wear insert to couple with a neck flange at an end of the downstream neck of the RCD; and wherein the wear insert includes at least one of:

an upstream portion having at least one upstream seal recess to accommodate at least one upstream ring seal between an exterior of the wear insert and an interior of the downstream neck of the RCD; or a downstream portion adjacent to the retainer flange having at least one downstream seal recess to accommodate at least one downstream ring seal between the exterior of the wear insert and the interior of the downstream neck.

5. The wear sleeve of claim 4, wherein the retainer flange is integral with the wear insert.

6. The wear sleeve of claim 5, wherein the retainer flange is integral at an intermediate part of the wear insert in a manner that the wear insert extends from both sides of the retainer flange.

7. The wear sleeve of claim 4, wherein the retainer flange is mechanically coupled to the wear insert using a threaded connection.

8. The wear sleeve of claim 4, wherein:

the retainer flange includes a retainer recess, and the wear insert includes a wear protrusion extending from an outer surface of the wear insert to couple with the retainer recess.

9. The wear sleeve of claim 8, wherein the wear protrusion includes a seal recess for accommodating a ring seal between the wear protrusion and the retainer recess.

10. The wear sleeve of claim 4, wherein the retainer flange includes a retainer lip that abuts with an end of the wear insert.

11. The wear sleeve of claim 10, wherein the wear insert includes a seal recess to accommodate a ring seal between the wear insert and the retainer lip.

12. The wear sleeve of claim 10, wherein the retainer flange includes an upstream wear insert on a first side of the retainer lip and a downstream wear insert on a second side of the retainer lip.

13. The wear sleeve of claim 4, wherein the wear insert extends from both sides of the retainer flange.

14. The wear sleeve of claim 4, wherein a flange seal is accommodated in a ring recess between the neck flange and the retainer flange.

15. The wear sleeve of claim 4, wherein the retainer flange includes release threaded holes that align with a surface of the neck flange to separate the retainer flange from the neck flange when a bolt is completely inserted through the release threaded holes.

16. The wear sleeve of claim 4, wherein the retainer flange includes additional adjustment holes located on an outer circumference of the retainer flange.

17. The wear sleeve of claim 4, wherein the retainer flange includes indicators for a direction to rotate the wear sleeve.

18. A wear sleeve for use with a rotating control device (RCD), the wear sleeve comprising:

a wear insert formed in a tube shape with an outer profile to match an inner profile of a downstream neck of the RCD to be inserted into the downstream neck;

an insert protrusion that extends outwards from an outer circumference of the wear insert to match with a neck recess on the downstream neck of the RCD to limit movement of the wear insert in the downstream neck; and a plurality of grub screws to lock the wear insert within the downstream neck of the RCD; and wherein the wear insert includes a plurality of notches around an end of the wear insert.

* * * * *